US006205778B1

(12) United States Patent
Akaba et al.

(10) Patent No.: US 6,205,778 B1
(45) Date of Patent: Mar. 27, 2001

(54) EXHAUST PIPE ASSEMBLY FOR MULTI-CYLINDER INTERNAL COMBUSTION ENGINE

(75) Inventors: Manabu Akaba; Kazuhiro Furuhashi; Hideo Matsuzawa, all of Tochigi-ken (JP)

(73) Assignees: Kabushiki Kaisha Yutaka Giken, Hamamatsu; Honda Giken Kogyo Kabushiki Kaisha, Tokyo, both of (JP)

( * ) Notice: Subject to any disclaimer, the term of this patent is extended or adjusted under 35 U.S.C. 154(b) by 0 days.

(21) Appl. No.: 09/490,051

(22) Filed: Jan. 24, 2000

(30) Foreign Application Priority Data

Feb. 22, 1999 (JP) ..... 11-043248

(51) Int. Cl.[7] ..... F01N 7/10

(52) U.S. Cl. ..... 60/323; 60/313; 285/125.1; 285/405

(58) Field of Search ..... 60/323, 322, 313; 285/405, 407, 414, 416, 124.1, 125.1

(56) References Cited

U.S. PATENT DOCUMENTS 3,470,690 * 10/1969 Thompson ..... 60/32
3,507,301 * 4/1970 Larson ..... 137/602
4,373,329 * 2/1983 Martini ..... 60/305
4,656,830 * 4/1987 Ohno et al. ..... 60/276
5,887,428 * 3/1999 Garisto ..... 60/323
6,009,706 * 1/2000 Haneda ..... 60/323
6,038,855 * 3/2000 Markström et al. ..... 60/323
6,082,103 * 7/2000 Sugiura et al. ..... 60/323

FOREIGN PATENT DOCUMENTS 5-1819 1/1993 (JP) .

* cited by examiner

*Primary Examiner*—Thomas Denion
*Assistant Examiner*—Binh Tran
(74) *Attorney, Agent, or Firm*—Armstong, Westerman, Hattori, McLeland & Naughton

(57) ABSTRACT

An exhaust pipe assembly for a multi-cylinder internal combustion engine is made up of a plurality of exhaust pipes made of steel whose upstream ends are connected to a flange provided for connection to a cylinder head, a collecting case to which downstream ends of the exhaust pipes are connected, and a coupling flange interposed between the exhaust pipes and the collecting case. The coupling flange is made of a thin steel plate and has upward burred portions which are circular in shape and into which respective downstream ends of the exhaust pipes are separately inserted for welding with the burred portions, and a downward bent portion whose peripheral edge portion is fitted onto an upper outside end portion of the collecting case for welding with the bent portion.

4 Claims, 4 Drawing Sheets

EXHAUST PIPE ASSEMBLY FOR MULTI-CYLINDER INTERNAL COMBUSTION ENGINE

BACKGROUND OF THE INVENTION

1. Field of the Invention

The present invention relates to an exhaust pipe assembly for a multi-cylinder internal combustion engine, in which exhaust pipes to be connected to a head of the engine are made of steel pipes.

2. Description of the Related Art

The structure of an exhaust pipe assembly in which steel pipes are used in making exhaust pipes is shown in, e.g., Japanese Published Unexamined Utility Model Registration Application No. 1819/1993, as illustrated in FIGS. 6A through 6C. In FIG. 6A, reference alphabet "a" denotes a flange which is connected to a cylinder head of an internal combustion engine, reference alphabets b denote exhaust pipes which are made of steel pipes, alphabet c denotes a collecting case (or an assembly casing), and alphabet d denotes a flange which is connected to an exhaust gas purifier. Downstream ends of the exhaust pipes b are shaped into sectors (or fan shapes) $b_1$ as shown in FIG. 6B. The V-shaped portions (i.e., the portions formed by two radii) of the respective fan-shaped portions $b_1$ are welded together and are converged such that a series of arched portions substantially form a circle. The subassembly thus obtained is fitted into the collecting case c, and the subassembly and the collecting case are welded together. In FIG. 6C, a welded portion $W_1$ shows a cross-shaped welding performed along the V-shaped portions. A welded potion $W_2$ shows a welding performed between the arched portions and the collecting case.

In these welded portions, the cross-shaped welded portion $W_1$ must be welded along the entire length of the V-shaped portions so that the exhaust gases do not leak under pressure. In the welded portion $W_2$, attention must be paid so that gases do not leak under pressure through clearances e which are formed on outer corners of the arched portions. This kind of welding work is not easy to perform and is low in workability (or welding efficiency). In addition, there is a disadvantage in that welding defects, if any, cannot be easily located and repaired. Furthermore, in this example, since the above-described V-shaped portions are assembled on a back-to-back relationship in as many as at four portions, heat is accumulated to thereby raise the temperature therein. As a result, the temperature difference between the V-shaped portions and the outer arched portions becomes so large as to cause cracks. In order to minimize the possibility of occurrence of cracking, a high-quality and heat-resistant material must be used in the exhaust pipes b.

FIGS. 7A and 7B show another example of the conventional exhaust pipe assembly, in which an intermediate flange f is interposed between the exhaust pipes b and the collecting case c. The intermediate flange f is made by forming holes $f_1$ for receiving therein respective exhaust pipes b. The respective exhaust pipes b are then inserted into the holes $f_1$ and are welded to the flange f at welding portions $W_3$. This intermediate flange f is thereafter welded to the collecting case c at a welding portion $W_4$. In this example, the intermediate flange f must be provided, as shown in FIG. 7B, with an allowance (or a required length) $t_1$ for inserting the pipe as well as an allowance $t_2$ for welding. Therefore, the thickness T of the intermediate flange f becomes large and the heat is accumulated therein, with the result that the intermediate flange f is likely to be subject to a damage by the heat. To minimize this kind of disadvantage, a thicker and highly heat-resistant material must be used, resulting in a lager weight. In addition, if the distance 1 between the holes $f_1$, $f_1$ for inserting the exhaust pipes b is made smaller in an attempt to minimize the weight of the intermediate flange f, the strength of a metallic mold for use in punching the intermediate flange f becomes so low that the punching of the holes can no longer be performed. As a solution to this problem, the holes $f_1$, $f_1$ for inserting the pipes b must be made by an expensive way of working in the form of cutting. Even if these holes are formed by cutting work, the intermediate flange f is likely to cause cracks at welding beads due to thermal strains by welding, if the distance 1 is minimized.

The present invention has an object of providing an exhaust pipe assembly for a multi-cylinder internal combustion engine in which the members for assembling the plurality of exhaust pipes together can be made in a material which is less likely to accumulate heat and which is small in weight and less expensive.

SUMMARY OF THE INVENTION

In order to attain the above and other objects, the present invention is an exhaust pipe assembly for a multi-cylinder internal combustion engine comprising: a plurality of exhaust pipes made of steel, upstream ends thereof being connected to a flange provided for connection to a cylinder head; a collecting case to which downstream ends of the exhaust pipes are connected; and a coupling flange interposed between the exhaust pipes and the collecting case, the coupling flange being made of a thin steel plate, wherein the coupling flange comprises upward burred portions which are circular in shape and into which respective downstream ends of the exhaust pipes are separately inserted for welding with the burred portions, and a downward bent portion whose peripheral edge portion is fitted onto an upper outside end portion of the collecting case for welding with the bent portion.

According to this arrangement, the exhaust pipes, the coupling flange itself and the fitting portion can be formed light in weight. Therefore, the heat does not accumulate in these members, and they can be prevented from reaching an elevated temperature. It is thus not necessary to use an expensive and highly heat-resistant material to make the exhaust assembly. In addition, by providing the coupling flange with the burred portions and the bent portion, the area of dissipating the heat in the coupling flange increases to thereby improve the cooling characteristics. Still furthermore, the above-described arrangement of the exhaust pipe assembly facilitates the fitting and the welding of each of the portions, and the rigidity of the coupling flange increases. Due to this increased rigidity, the radiating sounds or noises from the coupling flange can be reduced. Furthermore, since the welding portions are circular and simple in shape, the welding work can be performed easily and the leak of exhaust gases under pressure can be easily detected.

Preferably, the burred portions are provided at a distance from one another. According to this arrangement, each of the burred portions is formed separately from, or independent of, one another at a distance therebetween. Therefore, the heat dissipating area becomes large and the cooling characteristics can be improved. As a result, heat is not accumulated in the coupling flange and, consequently, the concentration of thermal stresses in the coupling flange can be avoided.

Preferably, steel materials used in the exhaust pipes, in the coupling flange and in the collecting case have similar thicknesses. According to this arrangement, since the plate thicknesses of each of the members are close to one another, the thermal stresses hardly occur and, thus, the cracking at the welding bead can be prevented.

BRIEF DESCRIPTION OF THE DRAWINGS

The above and other objects and the attendant advantages of the present invention will become readily apparent by reference to the following detailed description when considered in conjunction with the accompanying drawings wherein:

FIGS. 6A through 6C are explanation drawings of one example of a conventional exhaust pipe assembly, in which FIG. 6A is a front view thereof, FIG. 6B is a cross-sectional view of a bottom portion of exhaust pipes, and FIG. 6C is a sectional view of an important portion thereof.

DETAILED DESCRIPTION OF A PREFERRED EMBODIMENT

A preferred embodiment of the present invention will now be explained with reference to the accompanying drawings.

Figure 1:
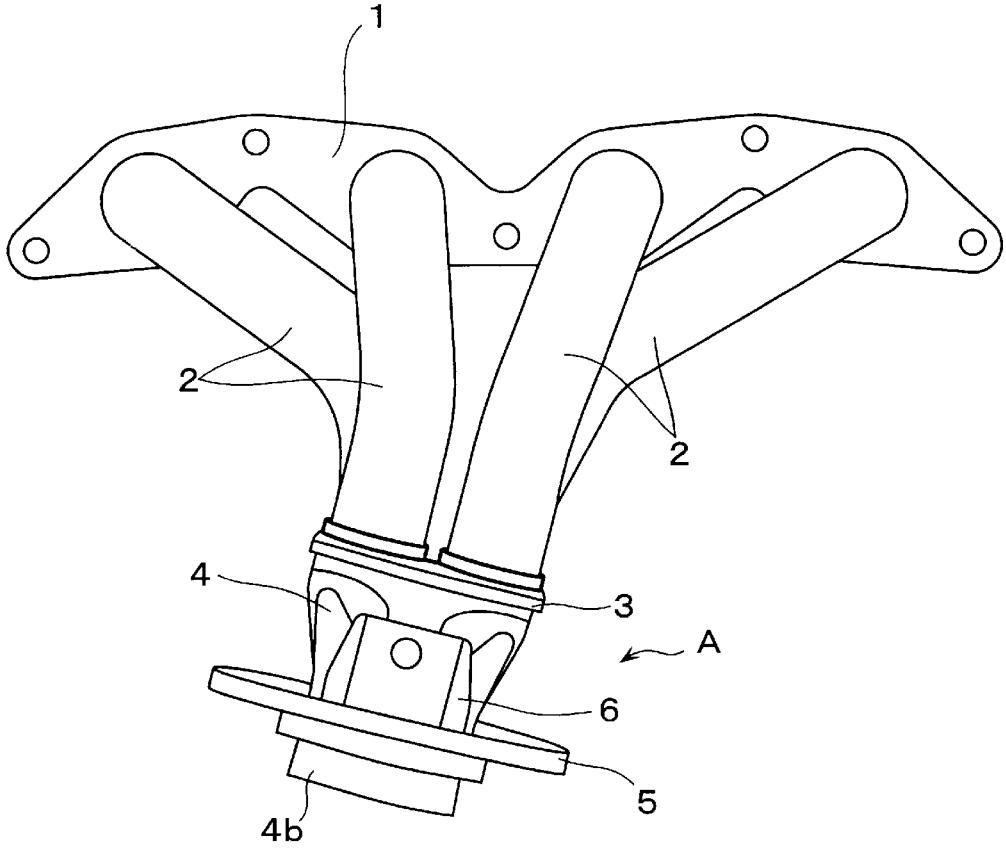
FIG. 1 is a front view of an exhaust pipe assembly according to an embodiment of the present invention.
Figure 2:
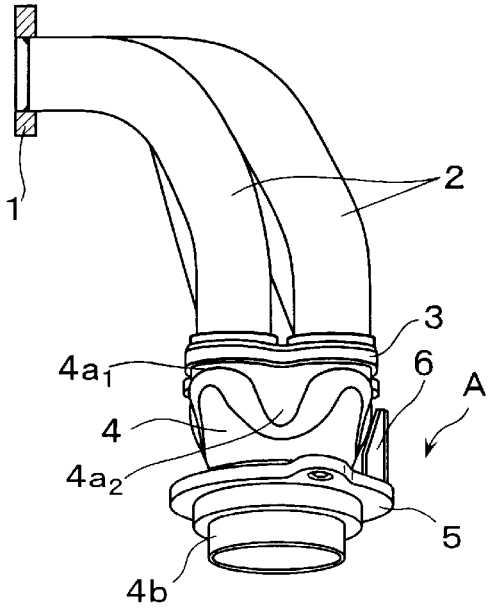
FIG. 2 is a side view thereof.

FIGS. 1 and 2 show an example of an exhaust pipe assembly in which the present invention is applied to a four-cylinder internal combustion engine. Reference numeral 1 denotes a flange which is provided on the side of a cylinder head. Reference numerals 2, 2, . . . denotes exhaust pipes which are manufactured by appropriately bending steel pipes. Reference numeral 3 denotes a coupling flange, reference numeral 4 denotes a collecting case, and reference numeral 5 denotes a flange on the downstream side of the exhaust gases. Reference numeral 6 denotes a fixing stay which is integrally provided on the flange 5.

Figure 3:
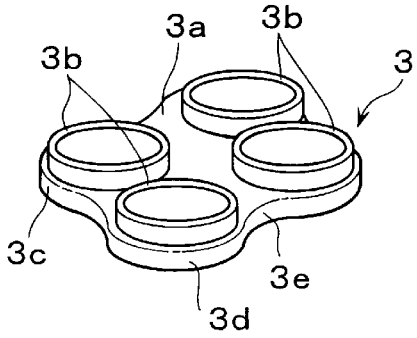
FIG. 3 is a perspective view of a coupling flange.
Figure 4:
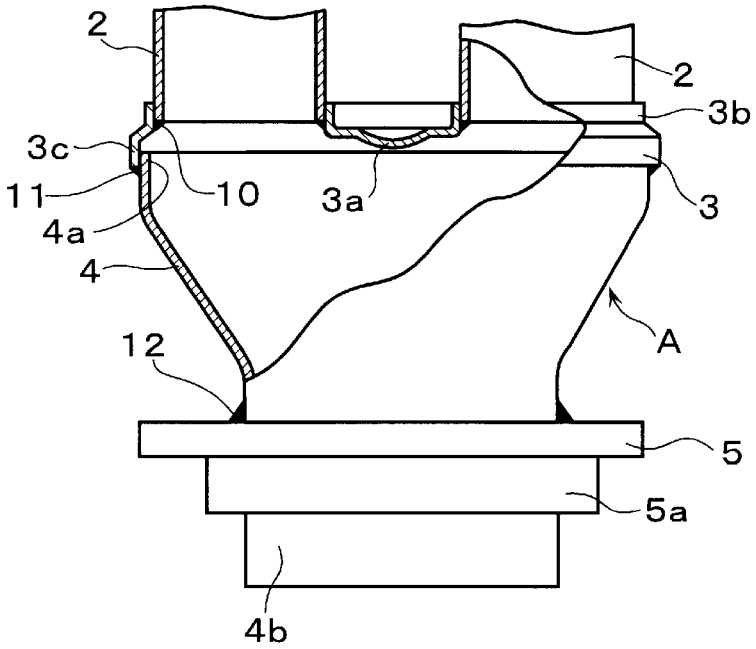
FIG. 4 is a side view, partly shown in section, of an important portion of the exhaust pipe assembly.
Figure 5:
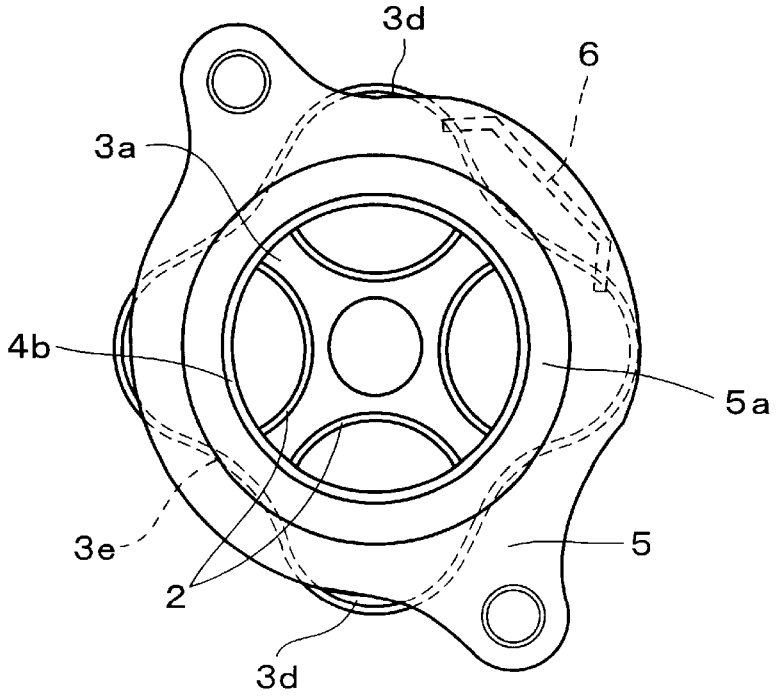
FIG. 5 is a bottom view thereof.
Figure 6A:
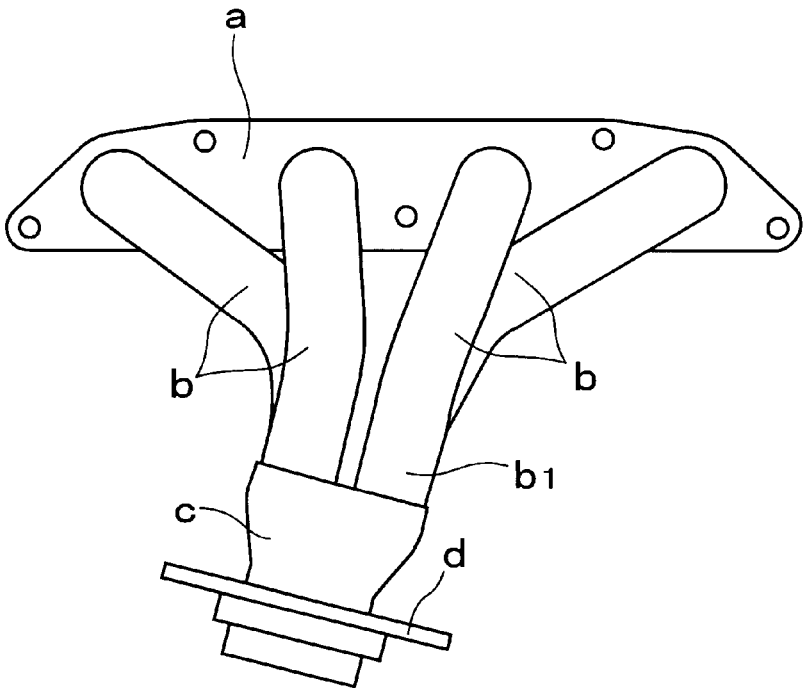
FIG. 6A PRIOR ART
Figure 6B:
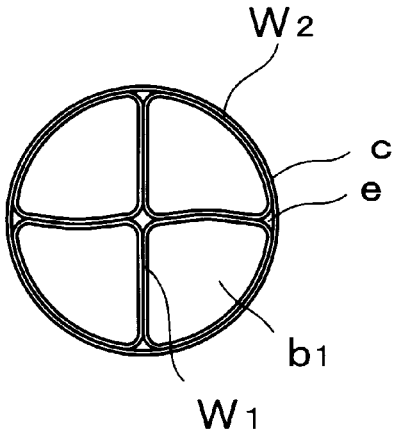
FIG. 6B PRIOR ART
Figure 6C:
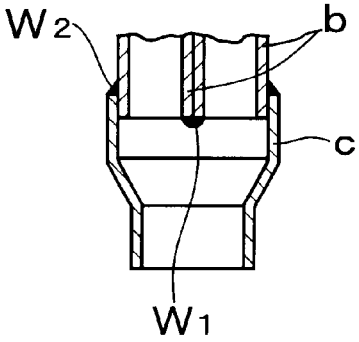
FIG. 6C PRIOR ART
Figure 7A:
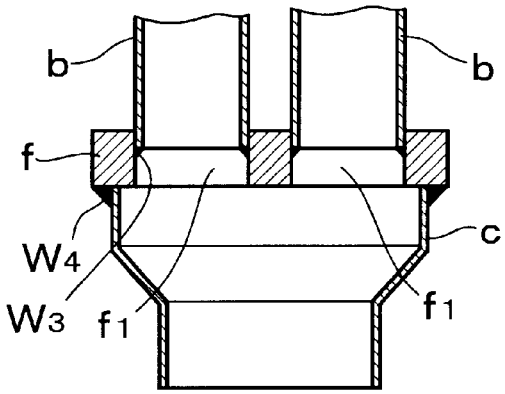
FIG. 7A PRIOR ART
FIGS. 7A and 7B are sectional views explaining another example of a conventional exhaust pipe assembly.
Figure 7B:
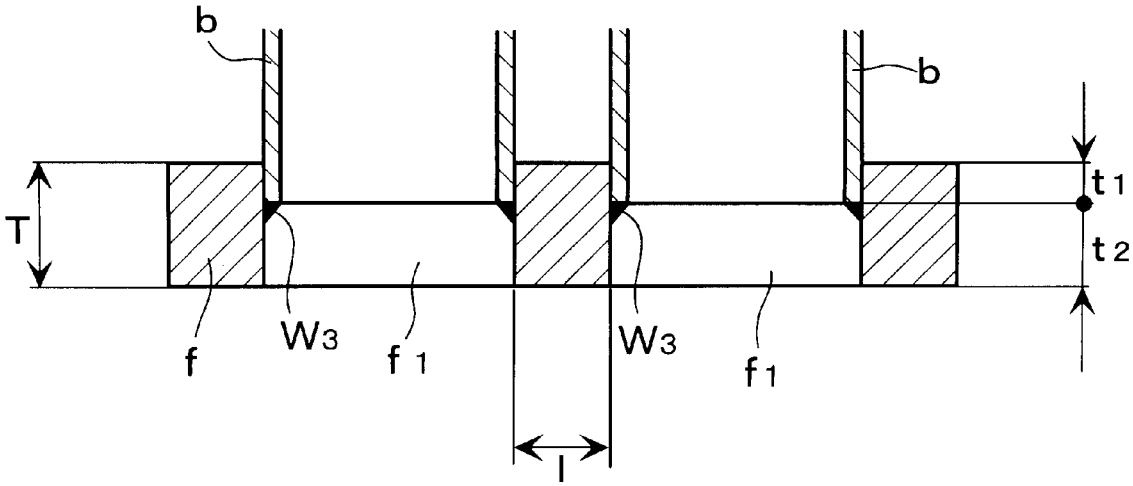
FIG. 7B PRIOR ART

The coupling flange 3 is manufactured by pressing a thin steel plate such that, as shown in FIG. 3, four burred portions 3*b* (i.e., portions projecting as a result of punching and bending work) are formed upward out of a main surface 3*a* independent of one another and at an equal distance to one another. A bent portion 3*c* which is bent downward is formed on an outer periphery of the pressed product. Here, in this specification, the term "thin"refers to such a thickness as is suitable for manufacturing the coupling flange 3 by the process of pressing work. This term is therefore to be construed to be of such a thickness as not to require cutting work which is referred to in the description of the related art. The contour of the main surface 3*a* and the bent portion 3*c* is such that the four corner portions have arcuate projections 3*d* which are coaxial with the arcuate outer periphery of the respective burred potions 3*b*. Between two arcuate projections 3*d*, 3*d* there is formed an arcuate recess 3*e*. As shown in FIGS. 4 and 5, the collecting case 4 has an upper end portion 4*a* which can be fitted, in a hermetically sealed manner, into a continuously contoured inner surface formed by the arcuate projections 3*d* and the arcuate recesses 3*e* of the bent portion 3*c*. The lower end of the collecting case 4 is formed into a cylindrical portion 4*b* so as to be closely fitted into a cylindrical portion 5*a* of the bottom flange 5.

As shown in FIG. 2, the above-described upper end portion 4*a* and an intermediate portion which continuously extends therefrom are provided with ribs which are made up of arcuate projections $\mathbf{4}a_1$ and arcuate recesses $\mathbf{4}a_2$. The height of both ribs is made to become gradually smaller toward the lower end. By providing the collecting case 4 with these ribs, the cross-sectional area of the collecting case 4 becomes larger and, therefore, the heat dissipation becomes large. In addition, the collecting case made of a thin plate can attain a high rigidity.

In manufacturing the exhaust pipe assembly, the following steps are taken. Namely, the exhaust pipes 2 and the coupling flange 3 are first welded together. In welding them, as shown in FIG. 4, the end portion of each of the exhaust pipes 2 is inserted into the respective burred portions 3*b* while securing a space for welding them together. The end portions of the exhaust pipes 2 are then welded at circular welding portions 10 to the inner surfaces of the burred portions 2*b*. In this arrangement, the end portions of the exhaust pipes 2 do not protrude or extend beyond the bottom surface of the coupling flange 3. Therefore, when the end portion of one of the exhaust pipes is welded by a welding electrode disposed in an inclined manner, the electrode will not interfere with the end portions of the adjoining exhaust pipes. In addition, by making the bent portion 3*c* to be of about the same height as that of the burred portion 3*b*, the interference of the inclined welding electrode with the bent portion 3*c* can be easily avoided.

Next, the upper end portion of the collecting case 4 is closely fitted into the inside of the bent portion 3*c* of the coupling flange 3. They are then welded together at a welding portion 11 to form a subassembly A. Then, the bottom flange 5 is fitted into the lower cylindrical portion 4*b*, and they are welded together at a welding portion 12. The flange 1 is thereafter welded to the inlet (or upstream) end of the exhaust pipes 2 to thereby obtain an integrally assembled exhaust manifold.

As can be seen from the explanations made hereinabove, according to one aspect of the present invention, since the amount of overlapping between the exhaust gas pipes and the burred portions of the coupling flange as well as the amount of overlapping between the bent portion and the collecting case are small, the mass of these portions can be made smaller. Further, since the burred portions and the bent portion function as heat-dissipating surfaces, the heat is not reserved within the coupling flange. It is therefore not necessary to use a highly heat-resistant material for the coupling flange. Furthermore, since the coupling flange is reinforced by the burred portions and the bent portion, the rigidity is improved and the radiating sounds or noises can be decreased. Still furthermore, since the welding construction is simple, the welding work as well as the detection of the gas leakage under pressure can be easily performed.

According to another aspect of the present invention, since the burred portions are provided at a distance from one another, the area of heat dissipation becomes larger and the cooling characteristics are improved. As a result, the coupling flange does not keep the heat therein, and the concentration of thermal stresses can be prevented.

According to still another aspect of the present invention, the steel materials used in the exhaust pipes, in the coupling flange and in the collecting case have similar thicknesses, the thermal stresses are small and cracking at the welding beads can be prevented. It is readily apparent that the above-described exhaust pipe assembly for a multi-cylinder internal combustion engine meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An exhaust pipe assembly for a multi-cylinder internal combustion engine comprising:

a plurality of exhaust pipes made of steel, upstream ends thereof being connected to a flange provided for connection to a cylinder head;

a collecting case to which downstream ends of said exhaust pipes are connected; and a coupling flange interposed between said exhaust pipes and said collecting case, said coupling flange being made of a thin steel plate, wherein said coupling flange comprises upward burred portions which are circular in shape and into which respective downstream ends of said exhaust pipes are separately inserted for welding with said burred portions, and a downward bent portion whose peripheral edge portion is fitted onto an upper outside end portion of said collecting case for welding with said bent portion.

2. The exhaust pipe assembly according to claim 1, wherein said burred portions are provided at a distance from one another.

3. The exhaust pipe assembly according to claim 1, wherein steel materials used in said exhaust pipes, in said coupling flange and in said collecting case have similar thicknesses.

4. The exhaust pipe assembly according to claim 2, wherein steel materials used in said exhaust pipes, in said coupling flange and in said collecting case have similar thicknesses.

* * * * *